United States Patent [19]

Van Rumpt et al.

[11] 3,938,642

[45] Feb. 17, 1976

[54] MAGNETIC KEY TOUCH CONTROL

[76] Inventors: Jaap Van Rumpt, Albertusstraat 16, Vught; Joop A. Spermon, van Lennephof 57, Oss, both of Netherlands

[22] Filed: May 17, 1974

[21] Appl. No.: 470,980

[52] U.S. Cl. ..... 197/98; 178/17 C; 340/365 R

[51] Int. Cl.[2] ..... B41J 5/08

[58] Field of Search ..... 197/98; 340/365; 235/145–146; 178/17, 77–81; 335/177–180

[56] References Cited

UNITED STATES PATENTS

| | | | |
|---|---|---|---|
| 3,363,737 | 1/1963 | Wada et al. | 235/145 X |
| 3,690,432 | 9/1972 | Kikuchi et al. | 197/98 |
| 3,696,908 | 10/1972 | Gluck et al. | 197/98 |
| 3,797,630 | 3/1974 | Zilkha | 197/98 |
| 3,831,730 | 8/1974 | Koeppe | 197/98 |

OTHER PUBLICATIONS

Stillings et al., "Magnetic Actuator Key Mechanism", IBM Tech. Disc. Bull., Vol. 15, No. 9, Feb. 1973.

Sulich et al., "Magnetic Key Mechanism", IBM Tech. Disc. Bull., Vol. 15, No. 7, Dec., 1972.

*Primary Examiner*—Edgar S. Burr
*Assistant Examiner*—R. T. Rader
*Attorney, Agent, or Firm*—Griffin, Branigan & Butler

[57] ABSTRACT

The "touch" or "feel" of a key in a keyboard is controlled by a system of permanent magnets. A first magnet is attached to one end of a key lever and the key lever is pivoted intermediate its ends. A bias spring is provided to normally bias the key lever against a stop. A second magnet is disposed adjacent the path of movement of the first magnet whereby the force required to depress the key lever is dependent upon the spring constant and the interaction of the fields of the magnets. The magnets are positioned such that, as the lever is depressed there is a repelling force between the magnets. Thus, the force required to depress the key is the sum of the spring bias force and the repelling force between the magnets as the first magnet is moved from the home position to a position opposite the second magnet, but is the difference between the spring bias force and the repelling force between the magnets as the key is further depressed.

6 Claims, 8 Drawing Figures

FIG. 1
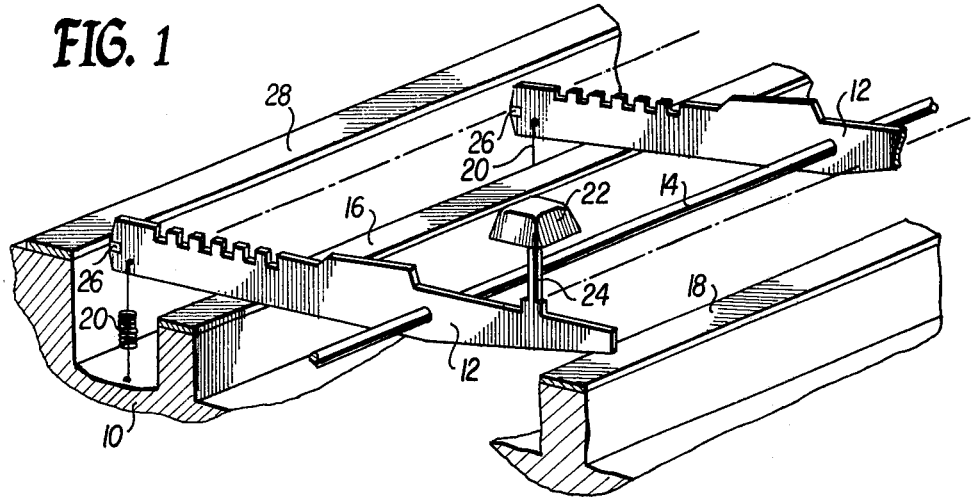
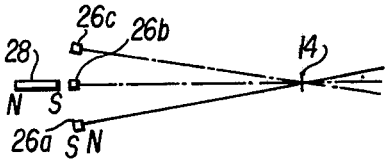
FIG. 2
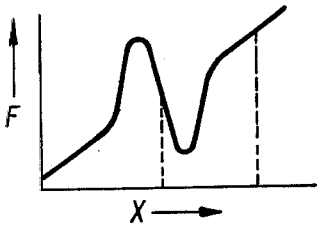
FIG. 3
FIG. 4
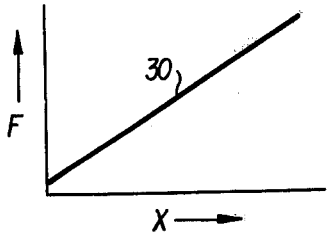
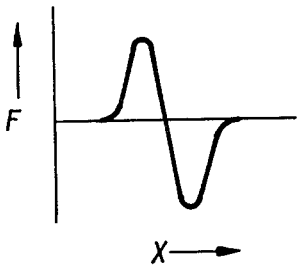
FIG. 5

FIG. 6
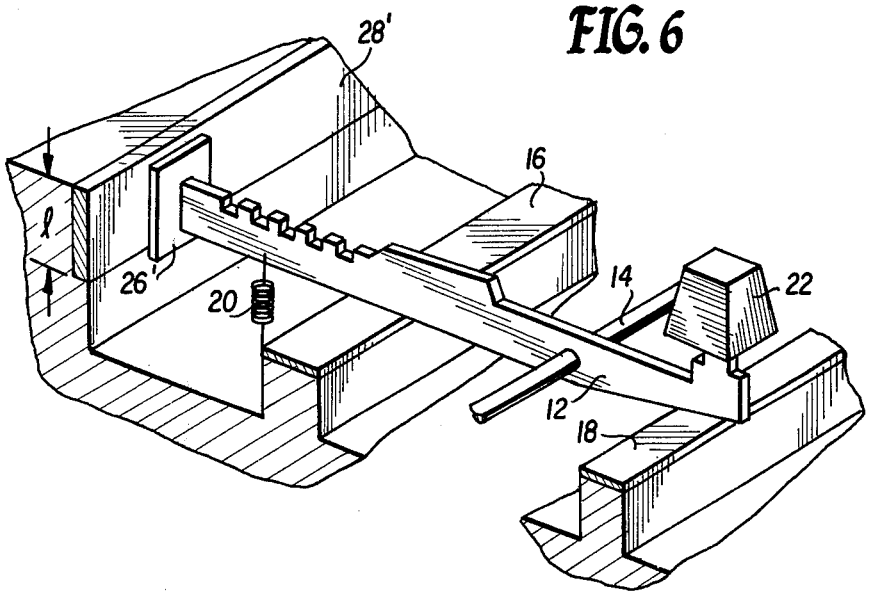
FIG. 7A
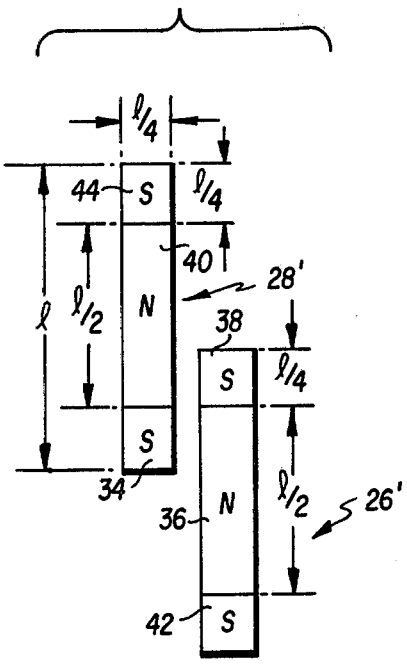
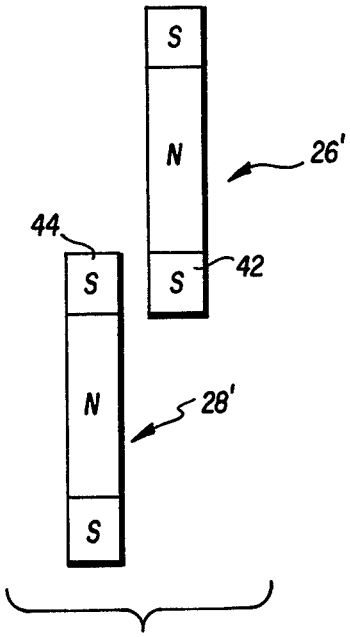
FIG. 7B

MAGNETIC KEY TOUCH CONTROL

BACKGROUND OF THE INVENTION

The invention relates to a key device for use in typewriter, calculator, and other keyboards. In particular, it relates to a key device that provides a feedback control feeling to a key operator, so that efficient key operation may be accomplished.

In typewriter keyboards and the like, key devices are required which offer a certain resistance to operation, so that an operator may sense successful actuation of a desired key. This resistance to operation is generally referred to as the "touch" or "feel". A minimal key resistance allows for this feel without creating any difficulty in operation, which would result in loss of efficiency. A present method achieves this feel through mechanical friction means. However, such friction means are subject to constant wear, and in a system with a plurality of keys this wear is often uneven, resulting in a non-uniform resistance force for all the keys. Accordingly, delicate adjustment is often required. Additionally, the feel offered by a solely frictional feel control device is merely a constant resistance force, which is less conducive to ideal control feeling than a detectable force variation. Hence, for efficiency and ease of use, a key system is needed which provides for a good control feeling, including a variable resistance force for each key that is uniform for a plurality of keys.

SUMMARY OF THE INVENTION

It is an object of this invention to provide for a key system a feel or touch control means which offers a variable resistance force for more sensitive operator touch control.

It is another object to provide a keyboard system wherein the control feeling for each key is uniform.

It is another object to provide a feel or touch control means for a key system which requires no mechanical friction means.

It is yet another object to provide a feel control means for a key system which is durable in operation and requires a minimum of adjustment.

A further object of the invention is to provide a key operated member biased toward a home position and carrying a first permanent magnet, and a second permanent magnet fixedly disposed adjacent the path travelled by the first magnet as the key operated member is actuated, whereby the force resulting from the opposing fields of the magnets sequentially aid, null, and then oppose the bias force applied to the member as the member is actuated.

Another object of the invention is to provide a keyboard including a plurality of key operated members as described above wherein a single bar magnet serves as the second magnet disposed adjacent the paths travelled by the first magnets.

Still another object of the invention is to provide a keyboard as described above wherein the key operated member is an elongated lever pivoted intermediate its ends and spring biased toward the home position, the lever being adapted to pivot against the force of the bias spring upon application of a force to a key.

In accordance with the principles of this invention, the objects as set forth above are obtained in a preferred embodiment by providing a key lever pivoted intermediate its ends and carrying a permanent magnet whereby upon application of a force to the key lever by a key, it pivots to move the magnet along an arcuate path. A bias spring normally biases the key lever toward a home position and a second permanent magnet is disposed adjacent the path of the first magnet at a location between the home position and a stop or fully actuated position of the key lever. The magnets are positioned with their poles arranged such that when the key lever is actuated the repelling forces of the magnets sequentially aid, null, and then oppose the bias force of the spring. This gives the key a "trigger feel". In a keyboard having a plurality of keys, an elongated bar magnet may serves as the second magnet for a plurality of key levers.

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed on illustrating the principles of the invention.

BRIEF DESCRIPTION OF THE DRAWINGS

FIG. 1 is a perspective view of a partial keyboard employing a magnetic trigger system according to the invention;

FIG. 2 is a diagrammatic view illustrating three sequential positions of an operated magnetic key-lever;

FIG. 3 is a graph illustrating a depression force depression distance relationship for good feedback feel in a key;

FIG. 4 is a graph illustrating the depression force depression distance relationship achieved by a spring member control element alone;

FIG. 5 is a graph illustrating the depression force - depression distance relationship achieved by interacting magnets alone;

FIG. 6 is a perspective view showing a different arrangement of magnets that may be used in practicing the invention; and, FIGS. *7a* and *7b* are diagrams illustrating the polling and relative positions of the magnets in an arrangement according to FIG. 6.

DESCRIPTION OF A PREFERRED EMBODIMENT

As illustrated in FIG. 1, a preferred embodiment of a keyboard employing a magnetic trigger feel control comprises a keyboard base 10, a plurality of key levers 12, and a pivot means 14 pivotally supporting the key levers above the base 10. The pivot means 14 is supported by the keyboard base in conventional manner so that the pivot means maintains a fixed position relative to the base.

Key lever stops, illustrated as resilient bumper pads 16 and 18, are provided for limiting the pivotal movement of the key levers about pivot means 14. Each key lever is provided with a bias means such as a spring 20 for biasing the lever toward a home position whereat the lever contacts stop 16. The right most lever of FIG. 1 is shown in this home position. Each key lever is further provided with a key 22 supported on a keystem 24 attached to the lever near one end thereof whereby manual depression of the key pivots the lever away from the home position toward a limit position where the lever strikes the stop 18.

A permanent magnet 26 is attached to each key lever at the end opposite that to which the key is attached whereby the magnet 26 travels an arcuate path as the key is depressed. A second permanent magnet 28 is disposed adjacent the arcuate paths travelled by permanent magnets 26 as their associated keys are depressed and released. The magnets 26 and 28 are disposed such that a pole of a magnet 26 faces a like pole of magnet 28 as the magnet 26 moves opposite magnet 28.

If magnets 26 and 28 were not provided, FIG. 4 would represent the force F that must be applied to a key 22 in order to move its associated key lever 12 a distance X. The curve 30 is defined by the equation $F=KX+Q$ where $F$ is force required to move the lever a distance $X$, $K$ is a constant determined by the spring characteristcs, and $Q$ is the bias force with which the spring holds the lever against the stop 16. The curve 30 is a straight line meaning that as the operator applies a steadily increasing force, there is a corresponding increase in the distance moved by the key lever. The reaction of the key to the operator's finger increases at a constant rate and never provides the operator with a "feel" as to when the key has been depressed far enough to accomplish the desired action.

FIG. 5 shows the pivoting force exerted on a key lever as result of the interacting magnetic fields of magnets 26 and 28 (but without a bias spring 20) this force being plotted as a function of the distance the key lever is moved from its home position. Considering FIG. 2 is conjunction with FIG. 5, 26*a* represents the position of magnet 26 relative to magnet 28 when the key lever is in the home position. At this time the repulsive force between the magnets is negligible. As the key is depressed the magnet 26*a* moves toward magnet 28 until it reaches a position 26*b* directly opposite magnet 28. The left most key lever of FIG. 1 is shown in this position. During this interval the magnetic force tending to pivotally repel the key lever increases, slowly at first, then quite rapidly, and finally decreases to zero quite rapidly as the magnet 26 moves directly opposite magnet 28. When the magnets are directly opposite each other, that is, when magnet 26 is in position 26*b*, the repelling forces between the magnets is greatest. However, this force is directed along the axis of the key lever and there is no magnetic force tending to pivot the key lever about pivot means 14.

As the key is depressed further so as to move magnet 26 from position 26*b* toward position 26*c*, the repelling force between the magnets 26 and 28 tending to pivot the key lever first increases rapidly in a negative sense, reaches a peak, and then decreases rapidly. However during this period the repelling force between the magnets tends to aid rather than oppose the force applied to the key lever from the key. Thus, as magnet 26 moves from position 26*a* to 26*b*, the reactive force of the key against the operators finger increases rapidly, then decreases to zero, after which the key lever moves still further with no increased force applied to the key by the operator.

Obviously a keyboard system having only magnets for controlling the touch would be undesirable since, as illustrated in FIG. 5, it would be necessary for the operator to lift up on a key in order to return the key lever to its home position. The operator force required to return the key lever would be exactly the same as that required to initially operate it.

The present invention incorporates both the repulsion forces of magnets and the bias force of a spring to obtain a very desirable touch characteristic which is the sum of force characteristics of a system employing only bias springs and a system employing only magnets.

FIG. 3 shows the relationship between the force applied to a key lever and the distance traveled by the key lever for the system of FIG. 1. From a comparison of the figures it is evident that the curve of FIG. 3 is a summation of the curves of FIGS. 4 and 5. When an operator depresses a key, a certain minimum force must be applied to the key to move the key lever away from the home position. This force is equal to the bias force of spring 20 which holds the key lever against stop 16. As the key lever is moved from the home position, the force required for continued movement increases linearly until the magnets 26 and 28 are close enough for interaction of their magnetic fields. The force of the magnetic fields opposes further movement of the key lever away from the home position and this force increases quite rapidly until it reaches a peak just before magnet 26 reaches the position 26*b*. Then, the opposing force of the magnetic fields drops quite rapidly to zero as magnet 26 moves through position 26*b* after which it rapidly increases in a sense tending to drive the key lever toward position 26*c*. Thus, as soon as the position of peak opposing force is reached, the reactive force of the key against the operator's fingers will decrease quite rapidly thereby enabling the operator to "feel" that the key has been depressed far enough to accomplish the desired action. The drawing shows no action accomplished by actuation of a key lever. However, those familiar with the art will readily understand that actuation of the key lever may be optionally, magnetically or electrically sensed to control an operation, or the key lever may initiate a desired mechanical action in a conventional manner.

When the operator releases the key, the force of the bias spring returns the key lever to the home position. During this return stroke the bias spring must overcome the repelling forces between the magnets 26 and 28 as the key lever moves from position 26*c* toward position 26*b*. During that portion of the return stroke between position 26*b* and 26*a*, the magnetic force aids the spring bias force in returning the key lever to the home position.

FIG. 6 illustrates a different embodiment of the invention which provides a better controlled force-displacement curve than the embodiment of FIG. 1. It also provides higher peak to peak force while permitting the movable magnets to be made of a very cheap plastoferrite.

In the embodiment of FIG. 6, the stationary magnet 28' may be elongated in the same manner as magnet 28 so as to function opposite one or more movable magnets 26'. FIGS. 7*a* and 7*b* are end views of the magnets 26' and 28', showing their relative positions when a key is at rest in the home position (FIG. 7*a*) and when the movable magnet 26' is at its furtherest extent of travel (FIG. 7*b*). Magnets 26' and 28' are poled as shown in FIGS. 7*a* and 7*b* with two poles of one polarity (South, for example) the poles being at opposite ends of a single pole of the opposite polarity (i.e. North). The single or North pole has a dimension ½ where 1 is the total height of the magnet. The South poles have a dimension ¼.

As shown in FIG. 7*a*, one South pole 34 of the fixed magnet 28' is opposite the upper portion of the North pole 36 of the movable magnet 26' when the movable magnet is in its home position. At the same time, South pole 38 of the movable magnet is opposite the lower half of the North pole 40 of the fixed magnet. When the movable magnet reaches its furtherest extent of travel as shown in FIG. 7*b*, the South pole 42 of the movable magnet 26 is opposite the South pole 44 of the fixed magnet 28'. In both of these positions, the net repelling for between the magnets, tending to rotate the key lever about its axis, is essentially zero. In between these two positions, as the magnet 26' is moved relative to the magnet 28' there is a varying magnetic force. The force varies first from zero to a maximum repelling force in one direction, then drops through zero repelling force to a maximum repelling force in the opposite direction, and finally returns to zero as the magnets reach the relative positions shown in FIG. 7*b*. Should magnet 26' be moved further upwardly relative to magnet 28' than is shown in FIG. 7*b*, the repelling force would again increase in the one direction, but would increase to a much smaller maximum than previously reached. This small peak would result from the repelling force between poles 42 and 44 as pole 42 moves upwardly. To avoid this second peak, the stop 18 (FIG. 6) should be positioned to stop key lever 12 when pole 42 is opposite pole 44 as shown in FIG. 7*b*.

When the forces between magnets 26' and 28' are combined with the bias force of spring 20, the net forcedistance relationship for the embodiment of FIG. 6 is essentially the same as that for FIG. 1, and is as shown in FIG. 3. However, because of the poling arrangement, the peaks, both positive and negative are greater for the embodiment of FIG. 6.

While a specific preferred embodiment of the invention has been described, it will be understood that various modifications and substitutions may be made therein without departing from the spirit and scope of the invention as defined by the appended claims. For example, magnet 28 may be replaced with a plurality of smaller magnets, one for each key lever.

We claim:

1. In a keyboard having a key lever pivoted intermediate its ends, a bias means pivoting said key lever in one direction toward a home position, and a manually depressible key means for pivoting the key lever in the opposite direction away from said home position toward a limit position, the improvement comprising:

a first permanent magnet attached to said key lever at one end thereof whereby said magnet travels an arcuate path between first and second positions as said key lever moves between said home and limit positions; and, a second permanent magnet disposed adjacent a point on said arcuate path that is between said first and second positions, said magnets being poled such that the magnetic fields of said magnets create a force that aids said bias means as said first magnet moves toward said point from said first position, and opposes said bias means as said first magnet moves away from said point toward said second position.

2. The improvement as claimed in claim 1 wherein said bias means comprises means for exerting on said key lever a pivoting force greater than any exerted thereon by the interaction of said magnetic fields, and wherein the forces of said magnets, acting through said key lever and said key means sequentially feed back to an operator's finger on said key means force feelings of repulsion, null and then propulsion as said key lever is pivoted to thereby move said first magnet from said first position through said point to said second position.

3. The improvement as claimed in claim 2 wherein said bias means is a spring.

4. The improvement as claimed in claim 1 wherein each of said magnets includes two poles of one polarity bounding a single pole of the opposite polarity.

5. The improvement as claimed in claim 1 wherein each of said magnets includes two poles of one polarity bounding a single pole of the opposite polarity, two poles of opposite polarities on one magnet being disposed adjacent two poles on the other magnet when said key lever is in the home position, said adjacent poles on the two magnets being of opposite polarities.

6. The improvement as claimed in claim 1 wherein each of said magnets comprises two poles of one polarity bounding a center pole of the opposite polarity, said magnets being disposed whereby a pole of one polarity on one magnet is opposite a pole of the same polarity on the other magnet when said key lever is in the limit position.

* * * * *